US005382762A

United States Patent [19]

Mochizuki

[11] Patent Number: 5,382,762

[45] Date of Patent: Jan. 17, 1995

[54] KEYSWITCH ASSEMBLY HAVING MECHANISM FOR CONTROLLING TOUCH OF KEYS

[75] Inventor: Isao Mochizuki, Gifu, Japan

[73] Assignee: Brother Kogyo Kabushiki Kaisha, Nagoya, Japan

[21] Appl. No.: 70,252

[22] Filed: Jun. 2, 1993

[30] Foreign Application Priority Data

Jun. 9, 1992 [JP] Japan ..... 4-046375[U]
May 14, 1993 [JP] Japan ..... 5-025135[U]

[51] Int. Cl.[6] ..... H01H 3/12
[52] U.S. Cl. ..... 200/5 A; 200/344
[58] Field of Search ..... 200/5 R, 5 A, 16 R, 200/16 A, 16 B, 16 C, 16 D, 517, 521, 329, 341, 342, 343, 344, 345

[56] References Cited

U.S. PATENT DOCUMENTS 4,433,225 2/1984 Cowles ..... 200/340
4,580,022 4/1986 Oelsch et al. ..... 200/340
4,902,862 2/1990 Oelsch et al. ..... 200/344
5,268,545 12/1993 Bruner ..... 200/345

*Primary Examiner*—A. D. Pellinen
*Assistant Examiner*—Michael A. Friedhofer
*Attorney, Agent, or Firm*—Oliff & Berridge

[57] ABSTRACT

A keyswitch assembly having a mechanism for controlling touch of a plurality of keys simultaneously, Each key is vertically movably supported on a holder member by a key support assembly. The key support assembly has first and second links intersecting with each other and pivotally connected together at the intersecting portion. A first end of the first link is pivotally connected to the key and a second end of the first link is slidably movable in a horizontal direction and is pivotally connected to the holder member. A first end of the second link is pivotally connected to the holder member, and a second end of the second link is slidably movable in the horizontal direction and pivotally connected to the key, A biasing segment is connected to the second end of the first link for urging the same. The biasing force of the biasing segment is controllable by moving an operation plate which is connected to the biasing segment.

20 Claims, 13 Drawing Sheets

KEYSWITCH ASSEMBLY HAVING MECHANISM FOR CONTROLLING TOUCH OF KEYS

BACKGROUND OF THE INVENTION

The present invention relates to a keyswitch assembly, and more particularly, to a keyswitch assembly suitable for use on a thin keyboard for a portable word processor, a portable personal computer or the like.

A conventional keyswitch assembly for use on such a keyboard has a key integrally provided with a key stem, a holder plate, and a switching member. The holder plate is provided with a key support or guide having a hole which receives the stem of the key to guide the key for vertical movement. The switching member is provided below the key stem. If the key is depressed, the lower end of the key stem presses the switching member for performing switching.

A keyswitch assembly having a large key, such as a space key and a return key, is provided with a mechanism for maintaining the key in a level position when the key is depressed regardless of the actual finger depressing position on these large keys. Such keyswitch assemblies are disclosed in U.S. Pat. No. 4,580,022 and U.S. Pat. No. 4,902,862.

In the keyswitch assembly disclosed in the U.S. Pat. No. 4,580,022, two scissors-like members serving as support levers are disposed below a key member for supporting the same. Two levers of each of the scissors-like members are pivotally linked to a shaft. A plurality of pins are disposed at extremities of the levers. When the key member is depressed, these pins are slidingly moved in a horizontal direction along the rear surface of the key member and along the upper surface of a base plate of the keyboard. With the structure, when the key member is depressed, the key member is moved downwardly while maintaining its level position. In accordance with this downward movement, a key depressing member suspended from the key member is slidingly guided by the key support, and buckles a rubber spring and presses the switching member disposed therebelow for switching action.

A key switch assembly disclosed in the U.S. Pat. No. 4,902,862 is the same in basic construction as the keyswitch assembly disclosed in the '022 patent, and is characterized in that the key member can be easily connected to and removed from the scissors-like support levers.

In the conventional keyswitch assemblies disclosed in the above U.S. patents, the key member is maintained in a level position regardless of the position at which pressure is applied to the key member, when the key member is moved vertically, even if the key member is a large key member such as the space key. In any of these prior art keyswitch assemblies, the stem for compressing the switching member or the key depressing member is guided for vertical sliding movement by the guide member in compressing the switching member.

Still another conventional keyswitch assembly is provided with a coil spring interposed between the lower surface of the key and the upper surface of the rubber spring in order to enhance touch of keys. By the replacement of the coil springs, the touch can be altered.

Recent progressive reduction in size and thickness of word processors and personal computers requires reduction in size and thickness of keyboards to be incorporated thereinto. On the other hand, the stroke of the keys of keyboards must be sufficiently large to facilitate keystroke operation and to secure a reliable keystroke. However, sufficiently large stoke of the keys is not obtainable in the prior art keyswitch assemblies.

When reducing the thickness of keyboard provided with the prior art keyswitch assemblies, the length of a sliding portion of the key stem in sliding engagement with the guide member must be reduced. However, if the length of the sliding portion of the key stem is reduced, the key is liable to tilt relative to the guide member, and consequently, the key stem is liable to slide awkwardly in the guide member, for example, local excessive sliding contact occurs when the key is depressed. On the other hand, if the length of the sliding portion of the stem in engagement with the guide member is increased to ensure smooth movement of the key, the stroke of the key is reduced.

If the key stem slides awkwardly in the guide member when the key is depressed, noise is generated and the keystroke operability may be degraded. The misalignment of the key stem with the guide member does not occur frequently if the key is always depressed in the central portion thereof. Hence, it may be possible to obviate the misalignment by reducing upper surface area of the key so that the key is always depressed in the central portion thereof. However, small area of the upper surface of the key may deteriorate facility in keystroke operation.

The keyswitch assemblies disclosed in the foregoing U.S. Patents are not intended to enable the reduction of the thickness of the keyboard. Since the key depression member for compressing the switching member protrudes downwardly from the key member, it would be difficult to form those keyswitch assemblies in a relatively small thickness. Further, the key provided with the key depression member has a complicated shape and hence increases the cost of the keyswitch assemblies.

Furthermore, since the pins formed at the extremities of the scissors-like support levers slide horizontally along the rear surface of the key member and the upper surface of the base plate, respectively, the position of the key with respect to horizontal direction is indefinite. Consequently, the key is likely to be dislocated horizontally when depressed, and the key stem is unable to operate the switching member reliably.

If the coil spring is additionally disposed on the upper surface of the rubber spring in an attempt to improve the touch of the keys, the key switch assembly becomes inevitably thick. In order to alter the touch of the keys, each of the coil springs must be replaced by new spring after the key is removed, which works require labors and skill.

SUMMARY OF THE INVENTION

It is therefore, an object of the present invention to overcome the above described drawbacks and to provide an improved keyswitch assembly capable of enhancing touch of keys without increase of thickness of a resultant assembly and capable of adjusting the touch of the plurality of keys simultaneously without removal of a key.

These and other objects of the present invention will be attained by providing a keyswitch assembly including a plurality of keys, a holder member, a plurality of key support assemblies, a plurality of switch portions, and means for simultaneously controlling touch of the plurality of keys. The holder member is positioned below the keys and having an upper surface. The holder member is formed with a plurality of openings. The plurality of key support assemblies is in equal numbers to the plurality of keys. Each key support assembly is provided between each key and the holder member for guiding vertical movement of the key. The plurality of switch portions is in equal numbers to the plurality of keys for performing switching operation in accordance with the vertical movement of the key. Each key support assembly includes a first link and a second link intersecting with the first link and pivotally connected thereto at their intersecting portion. The first link has a first end pivotally connected to the lower surface of each key and has a second end slidably movable in a first horizontal direction and opposite horizontal direction and pivotally connected to the upper surface of the holder member. The second link has a first end pivotally connected to the upper surface of the holder member, and a second end slidably movable in the first and opposite horizontal direction and pivotally connected to the lower surface of the key. The means for simultaneously controlling touch of the plurality of the keys is associated with each second end of the first link and is movable in a horizontal direction for changing urging force thereagainst in response to a change in a position of the controlling means relative to the holder member.

In another aspect of the invention, there is provided a keyswitch assembly including the plurality of keys, the holder member, the plurality of key support assemblies, the plurality of switch portions, a plurality of biasing means, and means for simultaneously changing biasing forces of the plurality of biasing means. Each of the plurality of biasing means is in contact with each second end of the first link. The means for simultaneously changing biasing forces of the plurality of biasing means is in contact with the plurality of the biasing means and is movable in a horizontal direction relative to the holder member.

If the key is not depressed the biasing force of the biasing means urges the second end of the first link in one horizontal direction toward the first end of the second link. Thus, the key is maintained in its upward position. On the other hand, if the key is depressed, the ends of the links are pivoted, and at the same time, the second end of the first link and the first end of the second links are slidingly moved in the horizontal direction against the biasing force of the biasing means. Therefore, the key is moved downwardly, and the intersecting portion of the links actuates the switching portion. If the key depression is stopped, the key can be moved upwardly by the force of the biasing means. The means for changing the biasing force of the biasing means change or control the biasing force of the biasing means. As a result, touch of all or selected numbers of the keys can be changed at one time.

BRIEF DESCRIPTION OF THE DRAWINGS

In the drawings;

FIG. 3(*b*) is a plan view showing a second link according to the first embodiment;

DETAILED DESCRIPTION OF THE PREFERRED EMBODIMENTS

Figure 1:
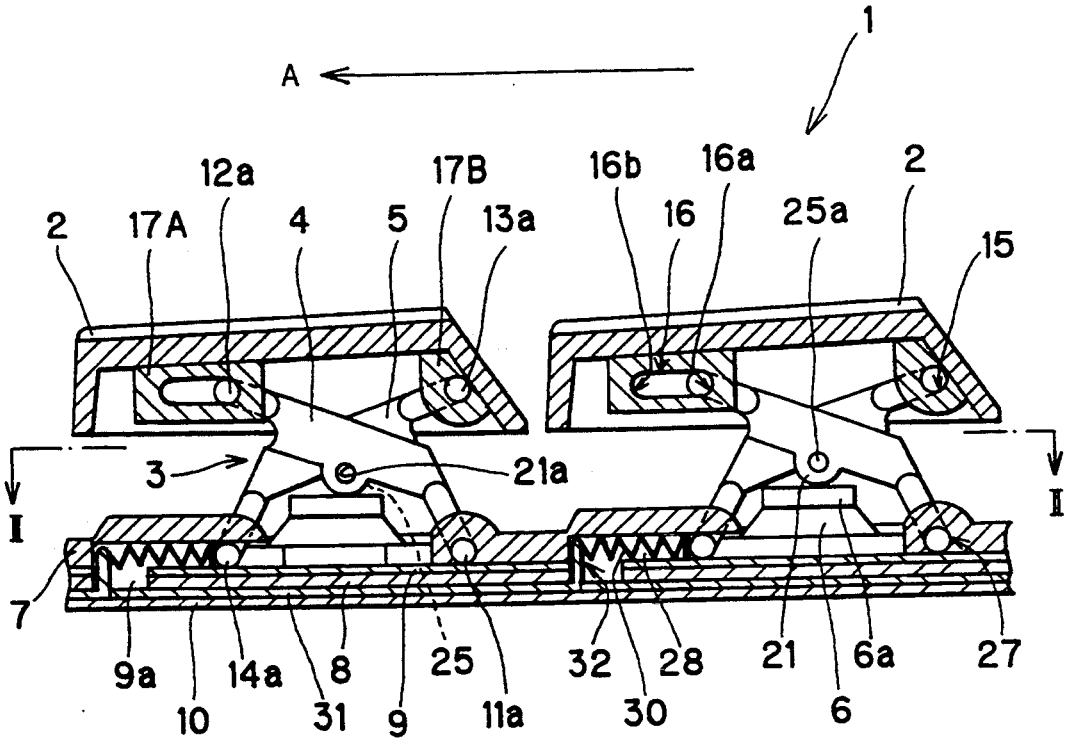
FIG. 1 is a cross-sectional side view showing a keyswitch assembly according to a first embodiment of the present invention and taken along a line I—I in FIG. 2, and showing a state in which a key has not yet been depressed.

A keyswitch assembly according to a first embodiment of this invention will be described with reference to FIGS. 1 to 6. As shown in FIG. 1, the keyswitch assembly includes a key 2, a key support member 3, a rubber spring 6, a holder plate 7, a flexible circuit board 9, a circuit board supporting plate 8, an operation plate 31, and a base plate 10.

The key support member 3 has first and second links 4 and 5 intersecting with each other in X fashion. The rubber spring 6, which serves as a vertical spring element, has a truncated-cone shape and is adapted to be pressed by the key support member 3. The holder plate 7, which serves as a guide member, is made of a synthetic resin and is adapted for supporting the key support member 3. The flexible circuit board 9 is positioned immediately below the holder plate 7 and immediately above the circuit board supporting plate 8. Below the circuit board supporting plate 8, the base plate 10 is disposed which provides an accommodation space for interposing the operation plate 31 between the circuit board supporting plate 8 and the base plate 10.

The key 2 is made of a synthetic resin such as ABS resin. A character such as an alphabetic character and numeral is formed by printing or the like on the upper surface of the key 1. A pair of first projections 17A and a pair of second upper projections 17B are formed integrally with the key 1 so as to project downward from the inner surface of the key 1. These projections are integrally molded with the key, or bonded thereto by an adhesive. The first projections 17A are formed with elongated slots 16, 16 for slidably receiving pins 12*a*, 12*b* (FIG. 3(*a*)) formed at the upper end of the first link 4. The pins 12*a*, 12*b* are slidably movable in a horizontal direction indicated by an arrow A in FIG. 1 within the slots 16, 16. The second projections 17B are formed with round holes 15, 15 for pivotally receiving pins 13*a*, 13*b* (FIG. 3(*b*)) formed at the upper end of the second link 5. The pins 12*b* and 13*b* are not shown in FIG. 1 since these are positioned just behind the pins 12*a* and 13*a*.

Next, the first and second links 4 and 5 are described with reference to FIGS. 1 through 3. These links are formed of synthetic resin reinforced with glass fibers or polyacetal resin, etc. As best shown in FIG. 3(*a*), the first link 4 has substantially H-shape arrangement in plan view having a base portion 18 and upper and lower free end portions 20 and 19. At a lower center portion of the base portion 18, the lower portion confronting the flexible circuit board 9, a semi-circular shaft support portion 21 projects downwardly as shown in FIG. 1, and a shaft supporting bore 21*a* is formed in the shaft support portion 21. The upper free end portion 20 has transversely extending right and left arm portions 20*a*, 20*b* from which the pins 12*a* and 12*b* protrude. Further, pins 11*a*, 11*b* extend from lower free end portion 19 in the rightward and leftward direction. Centers of the shaft supporting bore 21*a*, the pin 12*a* (12*b*) and the pin 11*a*(11*b*) are arrayed linearly in a side view of FIG. 1.

The second link 5 shown in FIG. 3(*b*) has substantially H-shape configuration in plan view having a base portion 22 and upper and lower free end portions 23, 24. At a lower center portion of the base portion 22, the lower portion confronting the flexible circuit board 9, a semi-circular shaft support portion 25 is formed. Further, a pivot shaft 25*a* extends from a side of the base portion 22. The pivot shaft 25*a* is rotatably inserted into the shaft supporting bore 21*a* of the first link 4. The lower free end portion 24 of the second link 5 has an arm portion 24*a* whose end portion is provided with pins 14*a* and 14*b*. The lower free end portion 24 also has an arm portion 24*b* from which a pin 14*c* projects. On the other hand, an upper free end portion 23 of the second link 5 has pins 13*a*, 13*b* extending laterally. Centers of the pivot shaft 25*a*, pins 13*a* (13*b*) and pins 14*a*, 14*b* (14*c*) are arrayed linearly in a side view of FIG. 1.

In the illustrated embodiment, as shown in FIG. 1, distance between the center of the shaft support bore 21*a* and the upper pin 12*a* is equal to that between the center and the lower pin 11*a*. Further, distance between the center of the pivot shaft 25*a* and the upper pin 13*a* is equal to that between the center and the lower pin 14*a*. With this structure, the key 2 can be maintained horizontally relative to the flexible circuit board 9. Moreover, as described later, when the key support member 3 is angularly rotatable about the lower pins 11*a*, 11*b*, displacement of the key 2 in the direction A and opposite the direction A can be avoided during vertical shifting of the key.

Incidentally, if the distance between the center of the shaft support bore 21*a* of the first link 4 and the lower pin 11*a*, the distance between the center of the pivot shaft 25*a* and the upper pin 13*a*, and the distance between the center of the pivot shaft 25*a* and the lower pin 14*a*, are provided equal to one another, the displacement of the key 2 in the direction A and opposite the direction A is avoidable during vertical stroke of the pin, even if the distance between the center of the shaft support bore 21*a* and the upper pin 12*a* is different from the above distance. However, in the latter case, it would be impossible to provide horizontal orientation of the key 2 relative to the flexible circuit board 9.

Figure 2:
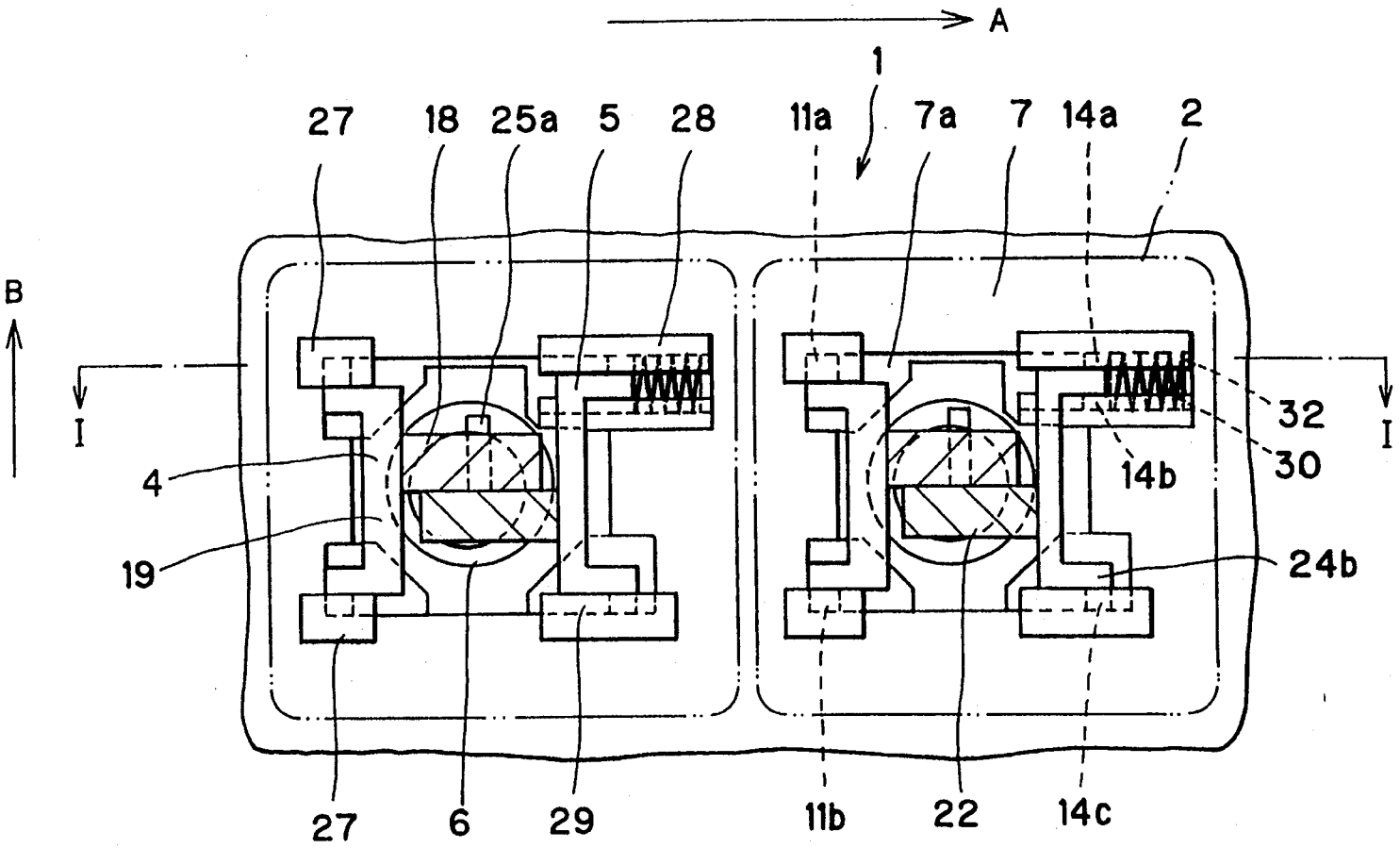
FIG. 2 is a plan view as viewed from a line II—II of FIG. 1 showing a key-depressing state according to the first embodiment.
Figure 3A:
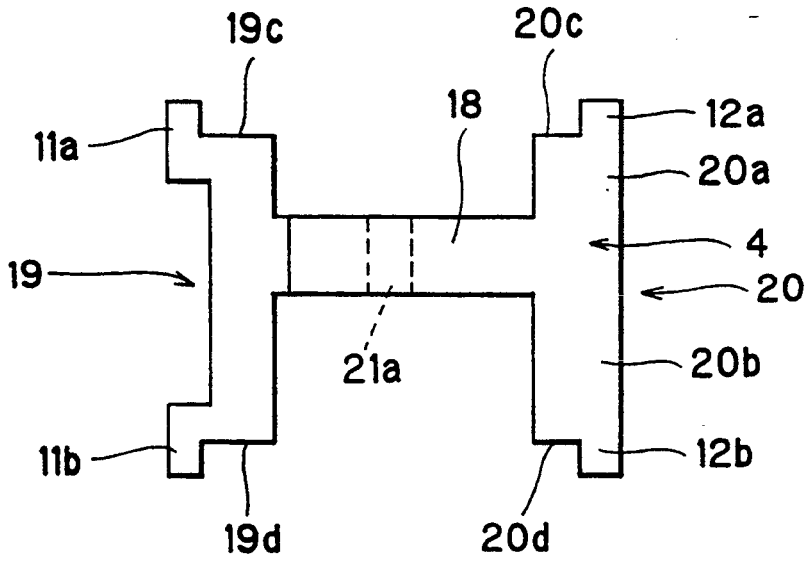
FIG. 3(*a*) is a plan view showing a first link according to the first embodiment.
Figure 3B:
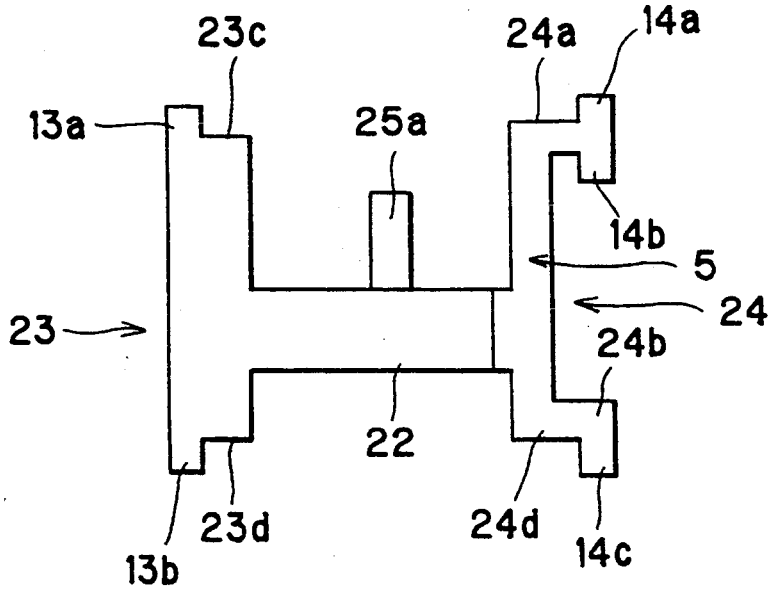
Figure 5:
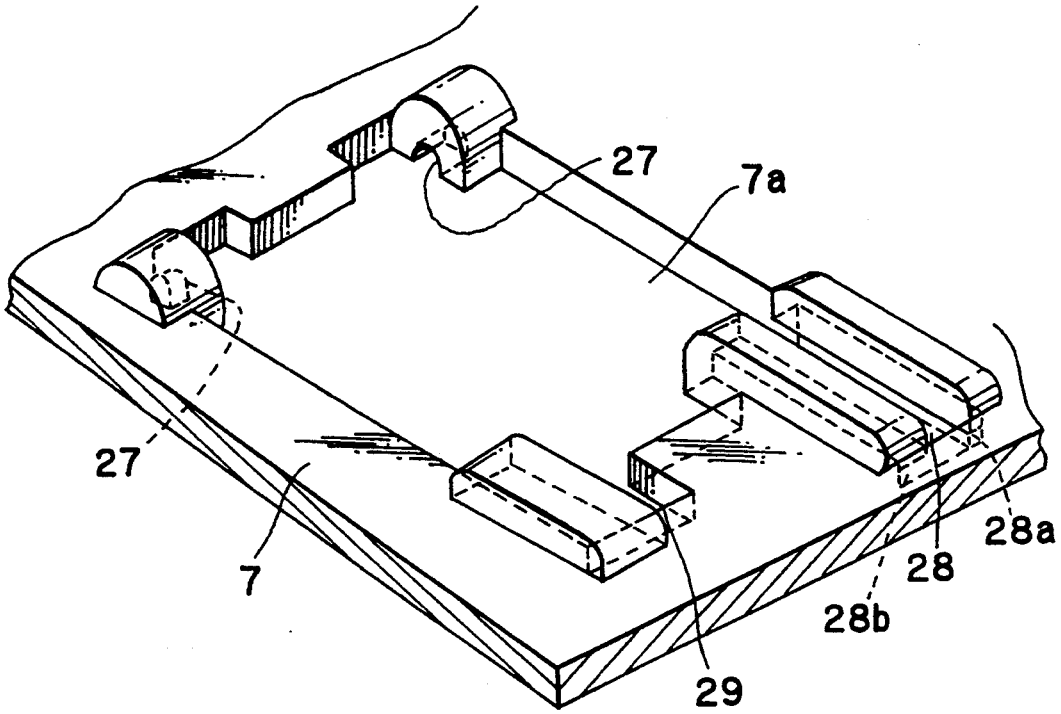
FIG. 5 is a perspective view showing a part of a holder plate according to the first embodiment.

As shown in FIGS. 2 and 5, the holder plate 7 formed of the synthetic resin reinforced with the glass fibers has a generally rectangular attachment opening 7*a* with which a flange portion provided at a lower end portion of the truncated-cone-like rubber spring 6 can be fitted without any deviation. At opposing edges of the attachment opening 7*a*, are provided a pair of bearing portions 27, 27 and a pair of slide bearing portions 28 and 29 formed with elongated grooves extending in the direction A in FIG. 2. These bearing portions are opened at their lower surfaces and are formed integrally with the holder plate 7. The lower pins 11*a*, 11*b* at the lower free end portion of the first link 4 are rotatably inserted from below into the pair of bearing portions 27, 27. Further, one of the slide bearing portions 28 has a pair of elongated grooves 28*b*, 28*b* with which the pair of pins 14*a*, 14*b* provided at the lower free end of the second link 5 are slidably fitted from below. Furthermore, the pin 14*c* provided at the lower free end of the second link 5 is slidably fitted, from below, with the elongated groove of the slide bearing portion 29.

The flexible circuit board 9 provided with a printed circuit pattern including switch electrodes underlies the holder plate 7. The rubber spring 6 is put on the flexible circuit board 9 at a position corresponding to the switch electrodes to function as a switching member of the present invention. The rubber spring 6 is provided internally with a known movable electrode. Further, the shaft supporting portion 21 of the first link 4 and relevant portion of the second link 5 for pivotally connecting the links 4 and 5 are disposed immediately above a top portion 6*a* of the rubber spring 6. The top portion 6*a* has a sufficient thickness capable of withstanding downward pressure imparted by the shaft supporting portions 21. Thus, when the shaft support portions 21 etc. are moved downwardly by depressing the key 2, these shaft supporting portions 21 apply pressure to the rubber spring 6. The rubber spring 6 buckles when the compressive strain thereof exceeds a predetermined value. Consequently, the switch electrodes are short-circuited by the movable electrode contained in the rubber spring 6.

The pins 12*a*, 12*b*, 14*a*, 14*b*, and 14*c* and slide bearing portions, 28, 29 and the slots 16, 16 are configured, so that the first and second links 4 and 5 are immovable in a direction indicated by an arrow B and a direction opposite the arrow B in FIG. 2 (in a direction perpendicular to the sliding direction of the link ends), and that the pins 12*a*, 12*b*, 14*a*, 14*b*, and 14*c* are slidingly movable in the direction A and the direction opposite the arrow A in FIG. 2. More specifically, end faces of the pins 12*a*, 12*b*, 14*a*, 14*b*, and 14*c* are in sliding contact with inner side walls of the slide bearing portions 28, 29 and the slots 16, 16. Thus, the key 2 can be vertically movable without any deviation in the direction B and the direction opposite B, and insertion of the pivot shaft 25*a* into the shaft bore 21*a* can be maintained.

Similarly, side end walls 20*c* and 20*d* at the upper free end portion of the first link 4 and side end walls 24*c* and 24*d* at the lower free end portion of the second link 5, the slide bearing portions 28, 29 and the slots 16, 16 are configured, so that the first and second links 4 and 5 are immovable in the direction indicated by the arrow B and the direction opposite the arrow B in FIG. 2 (in the direction perpendicular to the sliding direction of the link ends), and that the pins 12*a*, 12*b*, 14*a*, 14*b*, and 14*c* are slidingly movable in the direction A and the direction opposite the arrow A in FIG. 2. More specifically, the side end walls 20*c*, 20*d* at the upper free end portion 20 of the first link 4 and side end walls 24*c*, 24*d* at the lower free end portion 24 of the second link 5 are in sliding contact with inner side walls of the slide bearing portions 28, 29 and the slots 16, 16.

The pins 11*a*, 11*b*, 13*a*, 13*b* and the rotation bearing portion 27, 27, 15, 15 are configured, so that the first and second links 4 and 5 are immovable in the direction indicated by the arrow B and the direction opposite the arrow B in FIG. 2, and that the rotation of the pins 11*a*, 11*b*, 13*a*, 13*b* can be maintained without fail. More specifically, end portions of the pins 11*a*, 11*b*, 13*a*, 13*b* are in sliding contact with the bearing faces of the corresponding rotation bearing portions 27, 27, 15, 15. Thus, the key 2 can be vertically moved without any deviation in the direction B and the direction opposite B, and the thus construction can prevent the pivot shaft 25*a* from being disengaged from the shaft bore 21*a*.

Similarly, side end walls 19*c* and 19*d* at the lower free end portion 19 of the first link 4 and side end walls 23*c* and 23*d* at the upper free end portion 23 of the second link 5, and the rotation bearing portions 27, 27, 15, 15 are configured, so that the first and second links 4 and 5 are immovable in the direction indicated by the arrow B and the direction opposite the arrow B in FIG. 2, and that the pins 11*a*, 11*b*, 13*a*, 13*b* can be rotated without fail. More specifically, the side end walls 19*c*, 19*d* at the lower free end portion 19 of the first link 4 and side end walls 23*c*, 23*d* at the upper free end portion 23 of the second link 5 are in sliding contact with side surfaces of the corresponding rotation bearing portions 27, 27, 15, 15.

Next, a key touch adjusting mechanism for controlling manipulation force for depressing the key 2 will be described.

Figure 4:
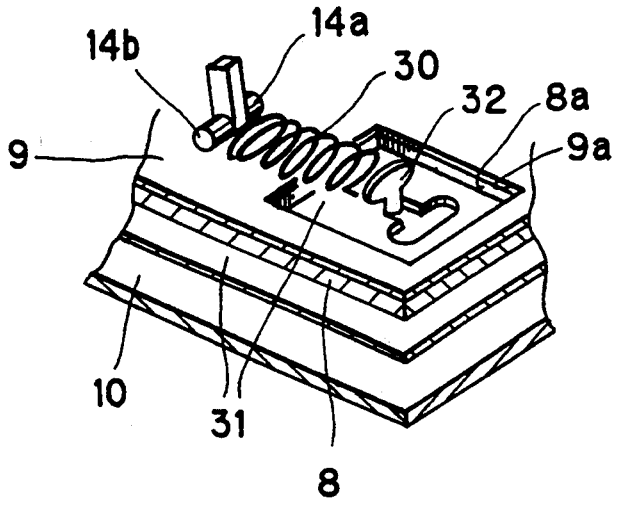
FIG. 4 is an exploded perspective view showing a key touch adjusting mechanism according to the first embodiment of this invention.

As shown in FIGS. 1, 2 and 4, a horizontally extending coil spring 30 is disposed within the slide bearing portion 28 for urging the pin 14*a*, 14*b* of the arm portion 24 of the second link 5 in a direction opposite the arrow A in FIG. 2. One side of the coil spring 30, the one side being positioned toward the direction A, is engaged with an engagement segment 32. By moving the engagement segment 32 in the direction A and opposite the direction A, the coil spring 30 is compressive force is changed, to thereby change urging force with respect to the pins 14*a* and 14*b*. Consequently, manipulation force necessary for depressing the key 2 is changed, i.e., touch of the key is changed. Since touch of the key is of operator's preference, the key touch adjusting mechanism will contribute improvement in key stroke operation.

Figure 6:
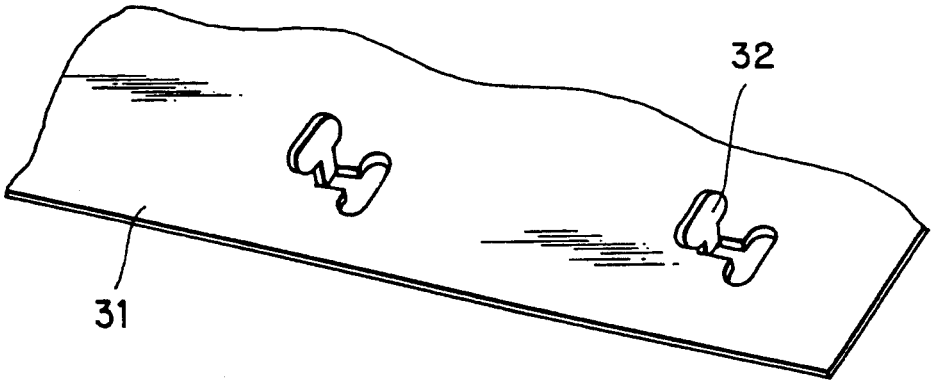
FIG. 6 is a perspective view showing a part of an operation plate which is a part of the key touch adjusting mechanism according to the first embodiment.

As shown in FIG. 6, a plurality of engagement segments 32 are provided by cutting the operation plate 31 at a predetermined intervals and bending the cut portions. As shown in FIG. 1, the operation plate 31 is disposed movable in the direction A and opposite the direction A at a space defined between the circuit board supporting plate 8 and the underlying base plate 10. As best shown in FIG. 4, in order to allow the movement of the operation plate 31, the flexible circuit board 9 and the circuit board supporting plate 8 are formed with openings 9*a* and 8*a* to surround the upstanding engagement segments 32, so that the operation plate 31 can be movable within a length of the openings. The position of the operation plate 31 can be fixed by screws (not shown).

Accordingly, after unfastening the screws, if the operation plate 31 is moved in the direction opposite the arrow A relative to the holder plate 7 and the position is fixed by the screws, the coil springs 30 are more compressed, so that its biasing force is increased. Reversely, if the operation plate 31 is moved in the direction A relative to the holder plate 7, the coil spring 30 expands to reduce the biasing force. Consequently touch of the key can be controlled. Readjustment is easily achievable by unfastening the screws and moving and fixing the operation plate 31. Incidentally, it is unnecessary to provide the key touch adjusting mechanism with respect to all keys 2. The key touch adjusting mechanism can be provided with respect to specific desired keys 2.

Operation in the keyswitch assembly 1 will next be described. In case of non-depressing state of the key 2, the pins 12*a*, 12*b* at the upper free end portion of the first link 4 abut one end 16*a* of the slots 16, and the pins 14*a*, 14*b*, 14*c* at the lower free end of the second link 5 are positioned at front ends (ends toward the direction opposite the arrow A in FIG. 2) of the slide bearing portions 28, 29 because of the upward resilient force by the rubber spring 6 and the biasing force of the coil springs 27 directing toward the rotary bearing portion 27 (the direction opposite the arrow A).

If the key 2 is depressed downwardly against the resilient force of the rubber spring 6 and the biasing force of the coil spring 30, the pins 13*a*, 13*b* at the upper free end portion of the second link 5 is angularly rotated within the rotary bearing portions 15 in accordance with the downward displacement of the key, and the pins 11*a*, 11*b* at the lower free end portion of the first link 4 are angularly rotated in the rotary bearing portions 27. At the same time, the pins 14*a*, 14*b*, 14*c* at the lower free end portion of the second link 5 are slidingly moved within the slide bearing portions 28, 29, and the pins 12*a*, 12*b* at the upper free end portion of the first link 4 are slidingly moved within the slots 16 in the direction indicated by the arrow A.

As a result, pivot shaft portion 21 at which the first and second links 4, 5 are intersectingly pivoted is moved downwardly and gradually compresses the rubber spring 6. When the descending distance exceeds a predetermined distance, buckling of the rubber spring 6 occurs. Thus, the movable electrode in the rubber spring 6 short-circuits the switch electrodes in the flexible circuit board 9 to perform a predetermined switching operation.

After this switching operation, the key 2 further moves downwardly in the key stroke operation. In this case, the pins 12*a*, 12*b* at the upper free end portion of the first link 4 is brought into abutment with another end of the slots 16. Therefore, the key depression is stopped. At this terminal phase, the pins 14*a*, 14*b*, 14*c* are slidingly moved in the slide bearing portions 28, 29. However, these pins do not abut rear end faces of the grooves (ends toward the direction A in FIG. 2).

Upon releasing the key 2, the pivot portion 21 of the links 4 and 5 is urged upwardly by the resilient restorative force of the rubber spring 6 and the coil spring 30. Consequently, pins 11*a*, 11*b*, 12*a*, 12*b*, 13*a*, 13*b*, 14*a*, 14*b*, 14*c* are moved reversely, so that the key 2 restores its original non-depressive position. The displacement of the key 2 in the directions A and B and reverse directions thereof is avoidable during stroke operation as well as non-operational state.

In the illustrated embodiment, the pins 11*a*, 11*b* at the lower free end portion of the first link 4 is angularly rotatably supported by the rotary bearing portion 27 at the holder plate 7, the pins 13*a*, 13*b* at the upper free end of the second link 5 are angularly rotatably supported by the rotary bearing portion 15 at the key 2, the centers of the pivot shaft 25*a* and the pins 13*a* and 14*a* are arranged in line, and, the distance between the center of the pivot shaft bore 21*a* and the center of the pin 11*a* at the lower free end of the first link 4, the distance between the center of the pivot shaft 25*a* and the center of the upper pin 13*a*, and the distance between the center of the pivot shaft 25*a* and the center of the lower pin 14*a* in the second link 5 are equal to one another. Therefore, the key 2 is not displaced in the direction A or the direction opposite A during vertical stroke motion in spite of the fact that the key 2 is pivotally moved about the pins 11*a*, 11*b* at the lower free end of the first link 4.

Further, in the illustrated embodiment, the pins 12*a*, 12*b*, 14*a*, 14*b*, 14*c*, and the slide bearing portions 16, 16, 28, 29 are configured so that the first and second links 4 and 5 are immovable in the direction B and the direction opposite B, and that these pins are smoothly slidably moved in the direction A and the direction opposite the direction A. To this effect, the end face portion of these pins are in substantial slide contact with the inner end faces of the slide bearing portions. Consequently, the key 2 can be moved vertically without any deviation in the direction B and the direction opposite the direction B.

In the keyswitch assembly in which a conventional key stem and its guiding arrangement can be dispensed with for providing a thin thickness, the operation plate 31 is movably and position-fixably disposed in the direction A and opposite the direction A. Thus, desired spring force for the desired key touch with respect to the plurality of keys can be uniformly and simultaneously adjusted. Further, in the key stroke operational and non-operational states, inadvertent displacement of the keys 2 in the directions A and B and reversal directions thereof can be obviated. Thus, resultant keyswitch assembly can provide desirable key operability and stabilized switching operation.

Figure 8:
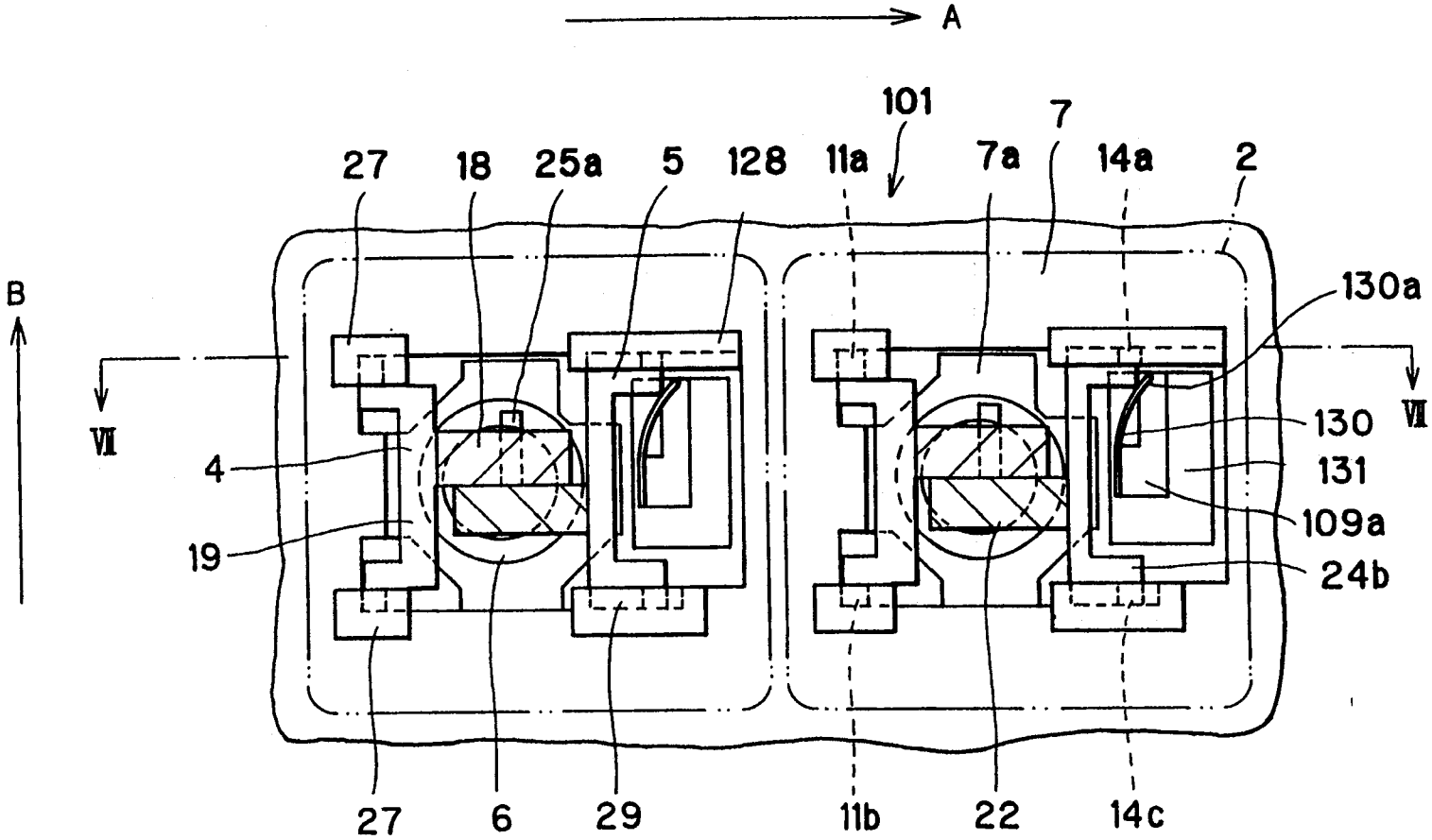
FIG. 8 is a plan view as viewed from a line VIII—VIII of FIG. 7 showing a key-depressing state according to the second embodiment.
Figure 9:
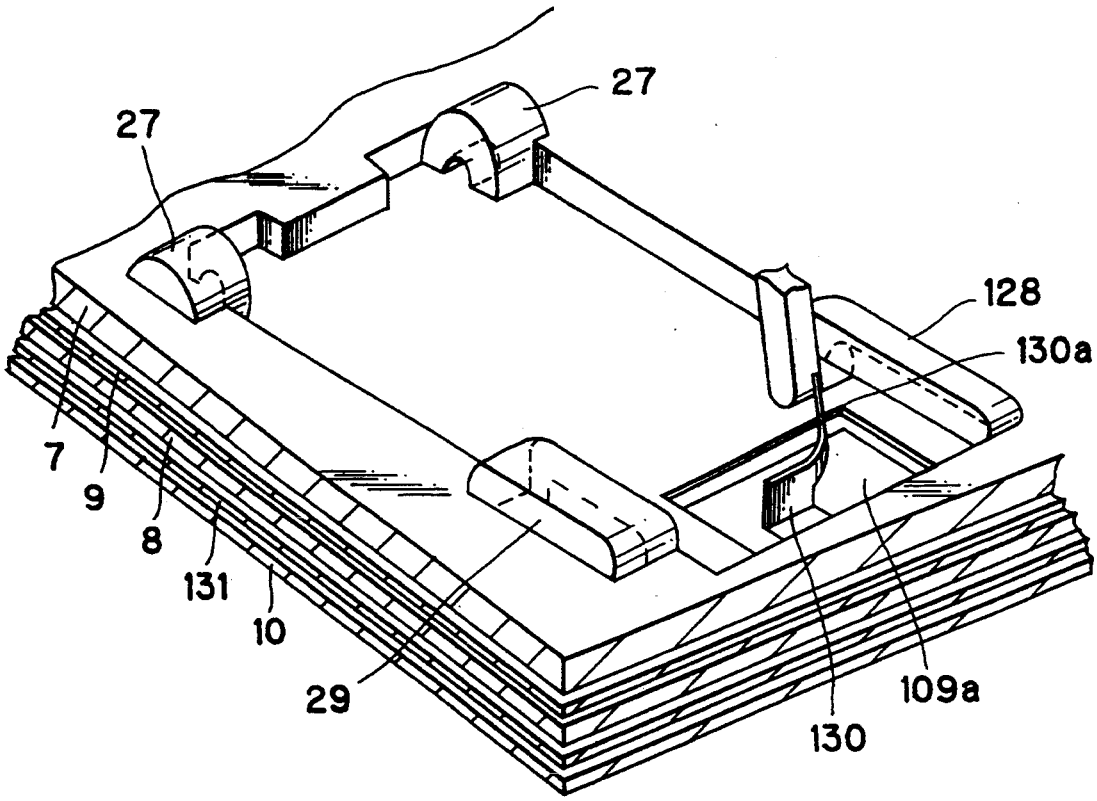
FIG. 9 is an exploded perspective view showing a key touch adjusting mechanism according to the second embodiment of this invention.
Figure 10:
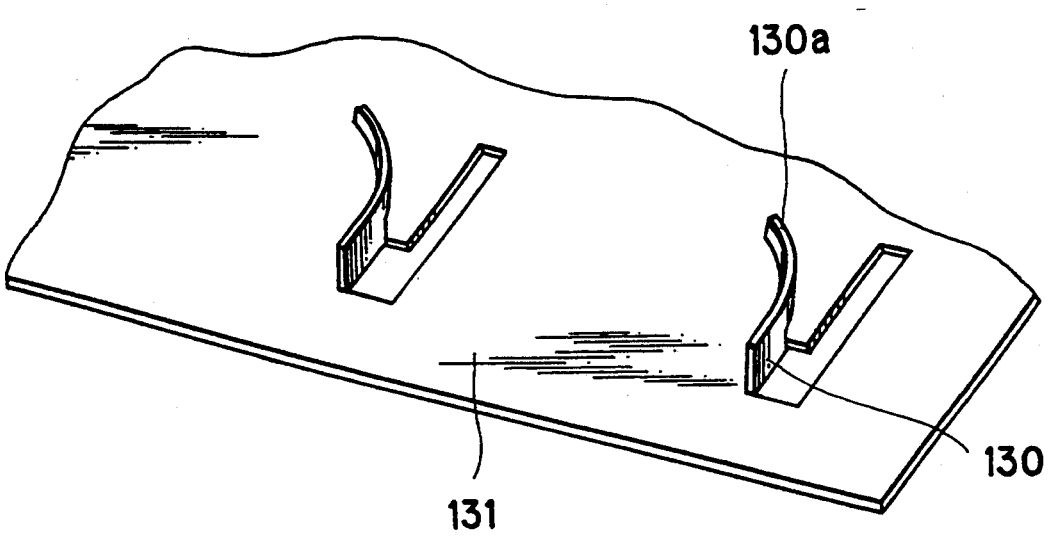
FIG. 10 is a perspective view showing a part of an operation plate which is a part of the key touch adjusting mechanism according to the second embodiment.

A keyswitch assembly according to a second embodiment of this invention will be described with reference to FIGS. 7 to 10. The second embodiment pertains to a modification to the key touch adjusting mechanism. A keyswitch assembly 101 includes a leaf spring 130 as the horizontally urging member instead of the coil spring as shown in FIGS. 8 and 9. As shown in FIG. 10, the leaf spring 130 is provided by partly cutting an operation plate 131 at a predetermined intervals and bending the cut portions. Thus, the leaf springs 130 are integral with the operation plate 131. As shown in FIG. 9, a free tip end 130*a* of the leaf spring 130 is arcuately bent toward the direction A so as to urge the pin 14*a* of the second link 5 toward the direction opposite the arrow A within the slide bearing portion 128.

As shown in FIG. 9, the flexible circuit board 9 and the circuit board supporting plate 8 are formed with openings 109*a* at positions corresponding to the leaf springs 130 to surround the same, so that each leaf spring 130 can project through each opening 109*a* from below and can be moved within the opening in the direction A and opposite the direction A in FIG. 8, i.e., in the sliding direction of the pin 14*a*.

Since the leaf springs 130 are provided integrally with the operation plate 131 as shown in FIG. 10, the leaf springs 130 are moved along with the operation plate 131. That is, if the operation plate 131 is moved in the sliding direction of the pin 14*a* of the second link 5 (in the direction A and opposite direction in FIG. 8), the leaf springs 130 are also moved in the direction. Therefore, spring force applied to the pin 14*a* is changeable. Thanks to the change in the biasing force, touch of the key 2 necessary for depressing the key 2 can be changed.

Figure 7:
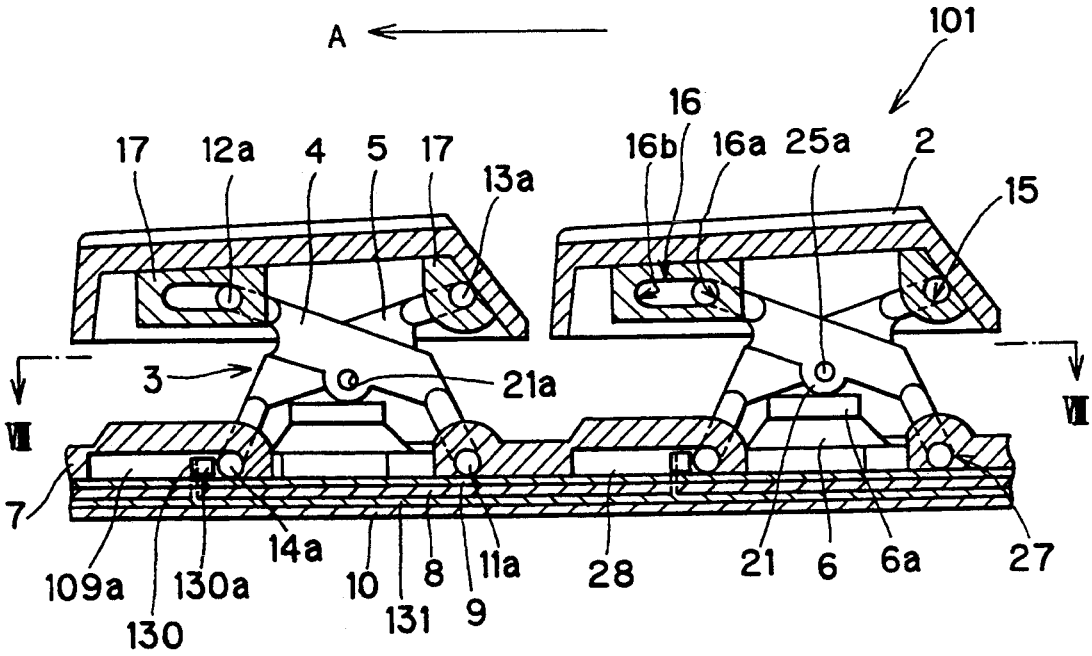
FIG. 7 is a cross-sectional side view showing a keyswitch assembly according to a second embodiment of the present invention and taken along a line VII—VII in FIG. 8, and showing a state in which a key has not yet been depressed.

Accordingly, if the operation plate 131 is moved in the direction opposite the arrow A in FIG. 7 relative to the holder plate 7, the leaf springs 131 undergo further compression to increase their biasing force. Reversely, if the operation plate 131 is moved in the direction A in FIG. 7 relative to the holder plate 7, the compressive force imparted on the leaf springs 130 is moderated to reduce their biasing force. Thus, key touch can be changed. Obviously, the operation plate 131 can be position-changeably fixed by using screws(not shown). Further, the key touch adjusting mechanism can be provided with respect to desired ones of the keys.

The leaf springs 130 in the second embodiment can further provide advantage in that numbers of mechanical parts can be reduced because of no provision of coil springs 30, to thereby facilitate assembling work, to thus reduce production cost.

Figure 12:
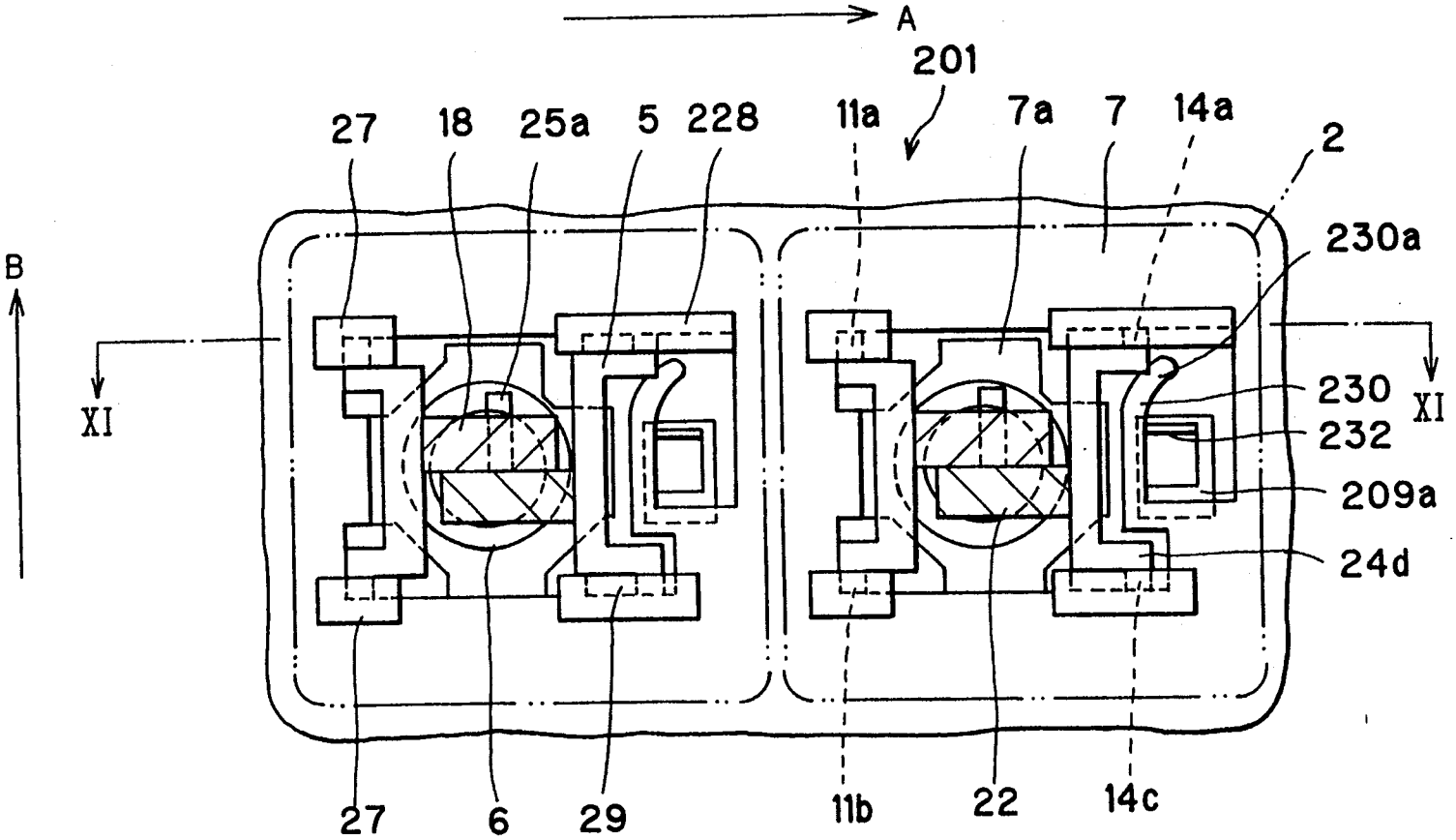
FIG. 12 is a plan view as viewed from a line XII—XII of FIG. 11 showing a key-depressing state according to the second embodiment.
Figure 13:
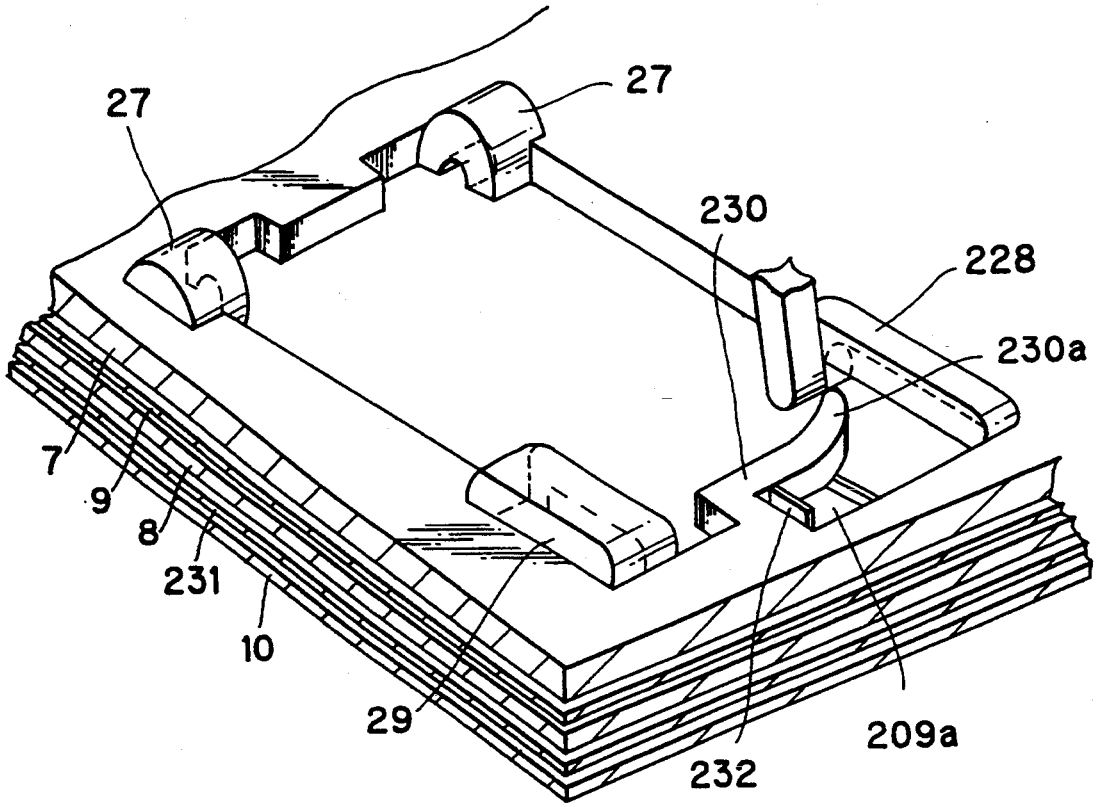
FIG. 13 is an exploded perspective view showing a key touch adjusting mechanism according to the third embodiment of this invention.

A keyswitch assembly according to a third embodiment of this invention will be described with reference to FIGS. 11 to 14. As shown in FIG. 13, the keyswitch assembly 201 has resin finger springs 230 as urging members for urging the pins 14*a*. Each of the resin finger springs 230 is provided integrally with the holder plate 7 and at a position between the slide bearing portions 228 and 29. The resin finger spring 230 extends toward the slide bearing portion 228 where the pin 14*a* of the second link 5 is slidably disposed. A tip end of the resin finger sporing 230 is slightly curved toward the rotary bearing portion 27 so as to urge the pin 14*a* in a direction opposite an arrow A in FIG. 11. The resin finger springs 230 are provided correspondingly to the keys 2.

Figure 14:
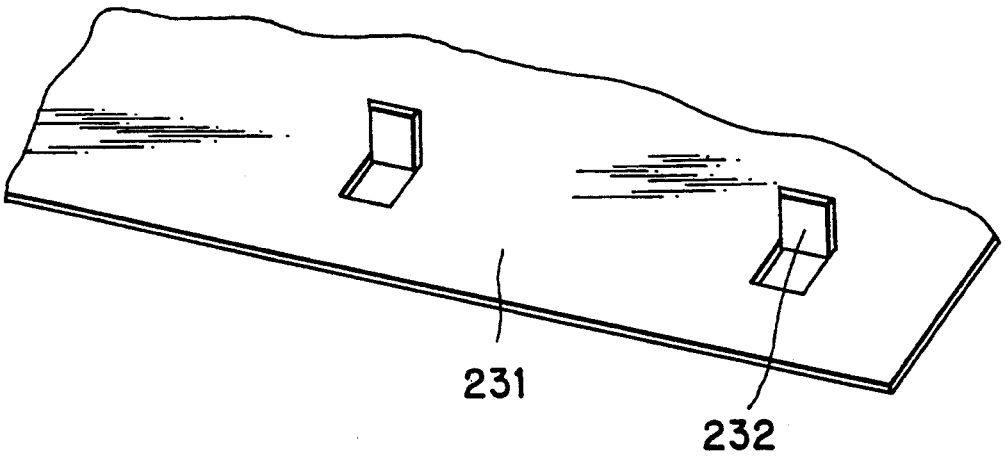
FIG. 14 is a perspective view showing a part of an operation plate which is a part of the key touch adjusting mechanism according to the third embodiment.
Figure 11:
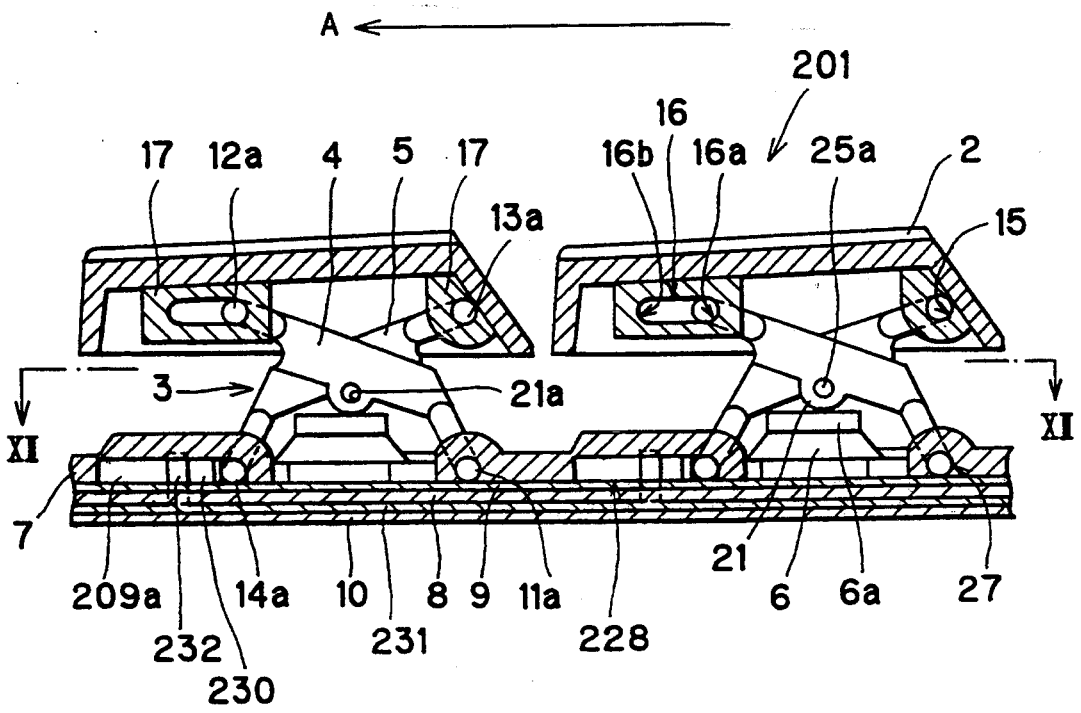
FIG. 11 is a cross-sectional side view showing a keyswitch assembly according to a third embodiment of the present invention and taken along a line XI—XI in FIG. 12, and showing a state in which a key has not yet been depressed.

Each one side face of the resin finger spring 230 is engageable with each engagement segment 232 formed by cutting an operation plate 231 at a predetermined intervals and bending the cut portions upwardly as shown in FIG. 14. As shown in FIG. 13, the operation plate 231 is movably inserted between the circuit board supporting plate 8 and the base plate 10. The operation plate 231 is movable in a direction indicated by an arrow B and a direction opposite the arrow B as shown in FIG. 12. That is, the operation plate 231 is movable in a direction perpendicular to the sliding direction of the pins 14*a*.

The flexible circuit board 9 and the circuit board supporting plate 8 are formed with a rectangular openings 209*a* at positions to allow the engagement segments 232 to pass therethrough. Major side of the opening 209*a* extends in the direction perpendicular to the sliding direction of the pin 14*a*, so that the engagement segments 232 together with the operation plate 231 can be moved without interference with the circuit board 9 and the supporting plate 8.

Since the engagement segment 232 is provided integrally with the operation plate 231, the engagement segment 232 is moved by the movement of the operation plate 231. By the movement of the operation plate 231, one side edge of the engagement segment 232 is in sliding contact with one side face of the resin finger spring 230*a*. Therefore, effective length of the resin finger spring 230*a* can be changed to thereby change its biasing force against the pin 14*a*.

For example, if the operation plate 231 is moved toward the tip end 230*a* of the resin finger spring 230 (in the direction B in FIG. 12) relative to the holder plate 7. effective length of each resin finger spring 230 is reduced. Accordingly, biasing force is increased. Reversely, if the operation plate 231 is moved toward a root end portion of the resin finger spring 230 (in the direction opposite the arrow B) relative to the holder plate 7, effective arm length of the resin finger spring 230 is increased, to thus reduce its biasing force against the pin 14*a*.

With this arrangement, by controlling the position of the operation plate 231 so as to obtain desired key touch, the position of the operation plate 231 is fixed by screws (not shown), to thus complete key touch adjustment. Readjustment can be made easily by unfastening the screws and moving and again fixing the operation plate 231. Incidentally, this adjusting mechanism can be provided with respect to desired keys. The third embodiment can provide advantage similar to the second embodiment in that numbers of mechanical components can be reduced for facilitating assembling work and for reducing production cost.

A keyswitch assembly according to a fourth embodiment of this invention will be described with reference to FIGS. 15 and 16. The fourth embodiment is similar to the third embodiment in that the resin finger springs 230 and engagement segments 232 are provided for controlling key touch. However, in the fourth embodiment, vertical spring members such as the rubber springs 6 for urging the keys upwardly are dispensed with. Instead, the biasing force produced by the finger springs 230 and the engagement segments 232 is greater than that in the foregoing embodiments where the rubber springs 6 are provided. With this arrangement, numbers of components can further be reduced, to reduce assembly process and production cost.

Figure 15:
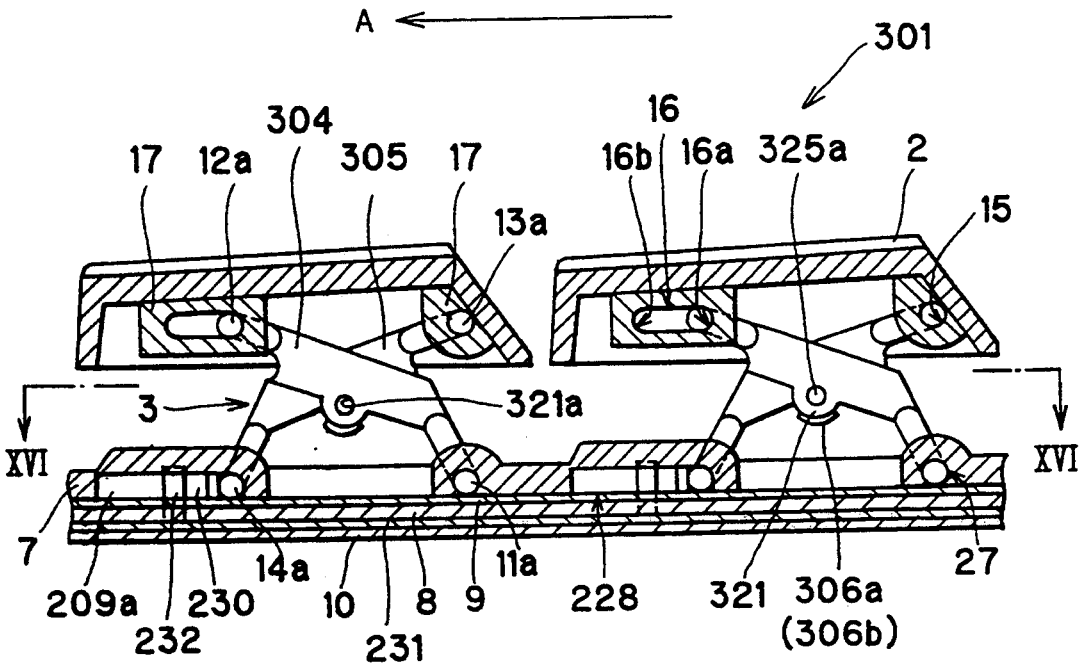
FIG. 15 is a cross-sectional side view showing a keyswitch assembly according to a fourth embodiment of the present invention and taken along a line XV—XV in FIG. 16, and showing a state in which a key has not yet been depressed.
Figure 16:
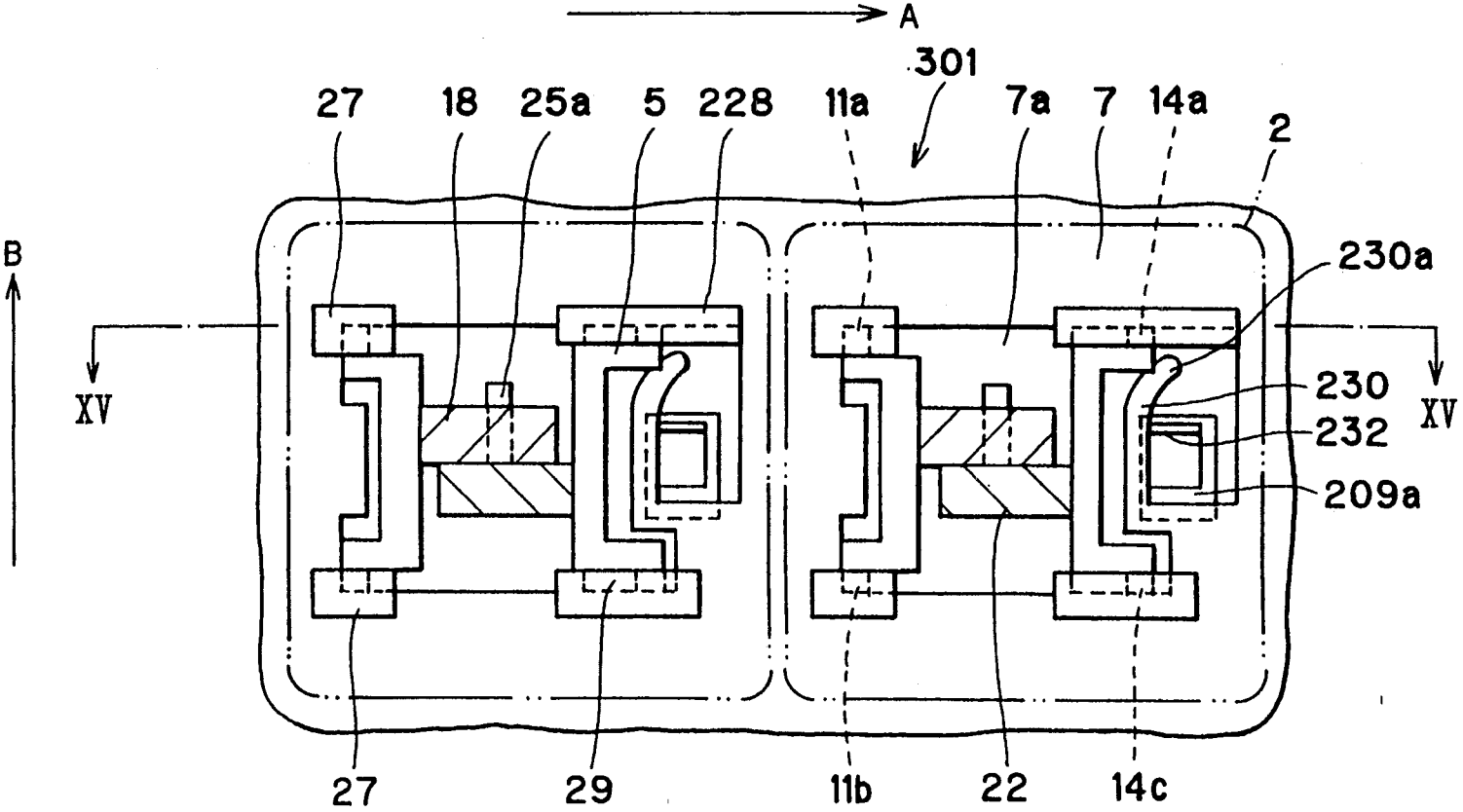
FIG. 16 is a plan view as viewed from a line XV—XV of FIG. 15 showing a key-depressing state according to the fourth embodiment.

More specifically, as shown in FIG. 15, the keyswitch assembly 301 includes the holder plate 7, the flexible circuit board 9 positioned below the holder plate 7 and having a predetermined print circuit pattern including switch electrodes, and switching members each including two links 304 and 305. These two links 304, 305 intersect with each other and are pivotally connected to each other similar to the foregoing links 4 and 5. However, pivot bearing portions 321 and 325 confronting the switching electrode are further provided with conventional movable electrodes 306*a* and 306*b*.

If the key 2 is depressed, the pivot shaft bearing portions 321, 325 are moved downwardly, and the movable electrodes 306*a*, 306*b* at the respective pivot shaft bearing portions 321, 325 are also moved downwardly. By further depression of the key 2, the movable electrodes 306*a*, 306*b* are brought into contact with the switching electrodes to short-circuit the switch electrodes.

If the key 2 is released, the pin 14*a* of the second link 305 is urged by the resin finger spring 230 in the direction opposite the arrow A in FIG. 15. Therefore, other slide pins 12*a*, 12*b*, 14*c* are also slidingly moved within the slide bearing portions 16, 16, 228, 28 in the direction opposite the arrow A, while the rotational pins 11*a*, 11*b*, 13*a*, 13*b* are angularly rotated within the rotary bearing portions 15, 15 27, 27. Therefore, the key 2 can restore its original upper position.

In the forth embodiment, the key 2 can restore its upper position because of only the biasing force of the horizontally urging resin finger springs without assistance of the vertically urging spring such as the rubber spring 6 in the foregoing embodiments. Therefore, mechanical parts can be reduced, to reduce the production cost and assembling labor. Further, the key touch can be adjusted by the adjustment of the biasing force of the resin finger spring similar to the third embodiment.

In view of the above, according to the present invention, key touch can be easily adjusted uniformly and simultaneously with respect to all keys or selected keys without increasing overall thickness of the keyswitch assembly.

While the invention has been described in detail and with reference to specific embodiment thereof, it would be apparent to those skilled in the art that various changes and modifications may be made therein without departing from the spirit and scope of the invention.

What is claimed is:

1. A keyswitch assembly comprising:

a plurality of keys each having a lower surface;

a holder member positioned below the keys and having an upper surface, the holder member being formed with a plurality of openings;

a plurality of key support assemblies in equal numbers to the plurality of keys, each key support assembly being provided between each key and the holder member for guiding vertical movement of the key;

a plurality of switch portions in equal numbers to the plurality of keys for performing switching operation in accordance with the vertical movement of the key;

each key support assembly comprising a first link and a second link intersecting with the first link and pivotally connected thereto at their intersecting portion, the first link having a first end pivotally connected to the lower surface of each key and a second end slidably movable in a first horizontal direction and opposite horizontal direction and pivotally connected to the upper surface of the holder member, and the second link having a first end pivotally connected to the upper surface of the holder member and a second end slidably movable in the first and opposite horizontal direction and pivotally connected to the lower surface of the key; and means for simultaneously controlling touch of the plurality of the keys, the controlling means being associated with each second end of the first link and being movable in a horizontal direction for changing urging force thereagainst in response to a change in a position of the controlling means relative to the holder member.

2. The key switch assembly as claimed in claim 1, wherein the key touch control means comprises:

an operation plate positioned below the holder member and being slidable in the first and opposite horizontal direction;

a plurality of upstanding segments extending from the operation plate, each of the upstanding segments being positioned in confrontation with the second end of the first link; and a plurality of biasing segments each interposed between each second end of the first link and each upstanding segment for urging each second end of the first link toward each first end of the second link.

3. The key switch assembly as claimed in claim 2, wherein the plurality of upstanding segments comprises cut-and-folded back portions of the operation plate.

4. The key switch assembly as claimed in claim 3, wherein the plurality of biasing segments comprise a plurality of coil springs.

5. The key switch assembly as claimed in claim 1, wherein the switching portions comprise a flexible circuit board having switching electrodes at positions in alignment with the openings of the holder member.

6. The key switch assembly as claimed in claim 5, further comprising a plurality of upwardly urging members each positioned above the flexible circuit board and contactable with the intersecting portion of each key support assembly for urging the keys upwardly.

7. The key switch assembly as claimed in claim 1, wherein the key touch control means comprises an operation plate positioned below the holder member and being slidable in the first and opposite horizontal direction;

a plurality of upstanding biasing segments extending from the operation plate, each of the upstanding biasing segments being positioned in contact with the second end of the first link for urging the second end of the first link toward the first end of the second link in the first horizontal direction.

8. The key switch assembly as claimed in claim 7, wherein each of the plurality of upstanding biasing segments comprises cut-and-folded back portions of the operation plate for serving as a leaf spring bent toward the first end of the second link.

9. The keyswitch assembly as claimed in claim 8, wherein the switching portions comprise a flexible circuit board having switching electrodes at positions in alignment with the openings of the holder member.

10. The key switch assembly as claimed in claim 9, further comprising a plurality of upwardly urging members each positioned above the flexible circuit board and contactable with the intersecting portion of each key support assembly for urging the keys upwardly.

11. The key switch assembly as claimed in claim 1, wherein the key touch control means comprises:

an operation plate positioned below the holder member and being slidable in a second horizontal direction and opposite horizontal direction, the second horizontal direction being perpendicular to the first horizontal direction;

a plurality of upstanding segments extending from the operation plate, each of the upstanding segments being positioned in confrontation with the second end of the first link; and a plurality of elongated biasing segments each extending from each opening of the holder member, each of the elongated biasing segments having one side in contact with each of the second ends of the first link and having another side in contact with each of the upstanding segments for changing urging force to the elongated biasing segment upon movement of the operation plate in the second and opposite horizontal direction.

12. The key switch assembly as claimed in claim 11, wherein the plurality of upstanding segments comprises cut-and-folded back portions of the operation plate.

13. The key switch assembly as claimed in claim 12, wherein the holder member is made of a resilient plastic material, and the plurality of elongated biasing segments being formed integrally with the holder member.

14. The key switch assembly as claimed in claim 13, wherein the switching portions comprise a flexible circuit board having switching electrodes at positions in alignment with the openings of the holder member.

15. The key switch assembly as claimed in claim 14, further comprising a plurality of upwardly urging members each positioned above the flexible circuit board and contactable with the intersecting portion of each key support assembly for urging the keys upwardly.

16. A keyswitch assembly comprising:

a plurality of keys each having a lower surface;

a holder member positioned below the keys and having an upper surface, the holder member being formed with a plurality of openings;

a plurality of key support assemblies in equal numbers to the plurality of keys, each key support assembly being provided between each key and the holder member for guiding vertical movement of the key;

a plurality of switch portions in equal numbers to the plurality of keys for performing switching operation in accordance with the vertical movement of the key;

each key support assembly comprising a first link and a second link intersecting with the first link and pivotally connected thereto at their intersecting portion, the first link having a first end pivotally connected to the lower surface of each key and a second end slidably movable in a first horizontal direction and opposite horizontal direction and pivotally connected to the upper surface of the holder member, and the second link having a first end pivotally connected to the upper surface of the holder member and a second end slidably movable in the first and opposite horizontal direction and pivotally connected to the lower surface of the key;

a plurality of biasing means each in contact with each second end of the first link; and means for simultaneously changing biasing forces of the plurality of biasing means, the biasing force changing means being in contact with the plurality of the biasing means and being movable in a horizontal direction relative to the holder member.

17. The key switch assembly as claimed in claim 16, wherein the plurality of biasing means comprise coil springs; and wherein the biasing force changing means comprises:

an operation plate positioned below the holder member and being slidable in the first and opposite horizontal direction; and a plurality of upstanding segments extending from the operation plate, each of the upstanding segments being positioned in confrontation with the second end of the first link, each coil spring being interposed between each second end of the first link and each upstanding segment for urging each second end of the first link toward each first end of the second link.

18. The key switch assembly as claimed in claim 16, wherein the biasing force changing means comprises an operation plate positioned below the holder member and being slidable in the first and opposite horizontal direction;

and wherein the plurality of biasing means comprise a plurality of upstanding biasing segments extending from the operation plate, each of the upstanding biasing segments being positioned in contact with the second end of the first link for urging the second end of the first link toward the first end of the second link in the first horizontal direction.

19. The key switch assembly as claimed in claim 16, wherein the holder member is made of a resilient plastic material, and the plurality of biasing means comprise elongated biasing segments each formed integrally with the holder member and extending from each opening of the holder member, each elongated biasing segments having one elongated side in contact with each second end of the first link and having another elongated side.

20. The key switch assembly as claimed in claim 19, wherein the biasing force changing means comprises:

an operation plate positioned below the holder member and slidable in a second horizontal direction and opposite horizontal direction, the second horizontal direction being perpendicular to the first horizontal direction; and a plurality of upstanding segments extending from the operation plate, each of the upstanding segments being slidingly contactable with each said another elongated side of each of the elongated biasing segments for changing the biasing forces of each of the elongated biasing segments upon movement of the operation plate in the second and opposite horizontal direction.

* * * * *